US005327812A

United States Patent [19]

Weyer et al.

[11] Patent Number: 5,327,812

[45] Date of Patent: Jul. 12, 1994

[54] FLUID-POWERED ACTUATOR AND METHOD OF ATTACHING MOUNTING PLATES

[76] Inventors: Paul P. Weyer, P.O. Box 398; Dean R. Weyer, 707 Victor, both of Enumclaw, Wash. 98022

[21] Appl. No.: 60,257

[22] Filed: May 12, 1993

[51] Int. Cl.[5] ..... F01B 31/08

[52] U.S. Cl. ..... 92/144; 92/31; 92/116; 92/161; 228/222; 414/722

[58] Field of Search ..... 92/82, 144, 161, 146, 92/31-33, 116; 414/722; 228/222

[56] References Cited

U.S. PATENT DOCUMENTS

| | | | |
|---|---|---|---|
| 4,223,197 | 9/1980 | Imai et al. | 228/222 |
| 4,892,993 | 1/1990 | Stol | 228/222 |
| 4,895,294 | 1/1990 | Thore | 228/222 |
| 4,906,161 | 3/1990 | Weyer | 414/723 |

*Primary Examiner*—Thomas E. Denion
*Attorney, Agent, or Firm*—Seed & Berry

[57] ABSTRACT

A fluid-powered actuator having a body with a shaft adapted for coupling to an external device to provide rotational drive thereto. A piston sleeve is mounted for reciprocal longitudinal movement within the body to provide rotational drive to the shaft. A plurality of seals are positioned within the body to provide a fluid-tight seal between the body and the shaft, and between the piston and both the shaft and the body. A pair of support members are positioned out of the body and fixedly attached to the body at spaced-apart locations. Each support member has an attachment portion extending circumferentially fully about the body, and a mounting portion. A pair of boom attachment plates are weldable to the mounting portions while the shaft, piston, torque-transmitting member, and seals remain assembled within the body. To avoid damage to the seals, a fluid channel is formed at least partially within each of the attachment portions and fully encircles the body. Cooling water is passed through the channel to absorb and transport away from the body a sufficient portion of the heat applied during welding of the attachment plates to prevent the heat from damaging the seals. Each of the channels is provided with a water inlet and a discharge outlet. In an alternative embodiment, the support member extends longitudinally along the body and defines a longitudinally extending fluid channel positioned between the support member and the body.

16 Claims, 6 Drawing Sheets

FLUID-POWERED ACTUATOR AND METHOD OF ATTACHING MOUNTING PLATES

DESCRIPTION

1. Technical Field

The present invention relates generally to fluid-powered actuators in which axial movement of a piston results in relative rotational or axial movement between a body and an output shaft, and more particularly to such actuators where side mounting plates are attached to the body.

2. Background of the Invention

Rotary helical splined actuators have been employed in the past to achieve the advantage of high-torque output from a simple linear piston and cylinder drive arrangement. The actuator typically uses a cylindrical body with an elongated rotary output shaft extending coaxially within the body, with an end portion of the shaft providing the drive output. An elongated annular piston sleeve has a sleeve portion splined to cooperate with corresponding splines on the body interior and the output shaft exterior. The piston sleeve is reciprocally mounted within the body and has a head for the application of fluid pressure to one or the other opposing sides thereof to produce axial movement of the piston sleeve.

As the piston sleeve linearly reciprocates in an axial direction within the body, the outer splines of the sleeve portion engage the splines of the body to cause rotation of the sleeve portion. The resulting linear and rotational movement of the sleeve portion is transmitted through the inner splines of the sleeve portion to the splines of the shaft to cause the shaft to rotate. Bearings are typically supplied to rotatably support the shaft relative to the body, and seals are supplied to prevent fluid leakage within the body and from the body.

A shortcoming of such rotary helical actuators, however, is realized when it is necessary to attach side mounting plates or brackets to the body by welding. One such situation arises when the actuator is used as part of a tiltable bucket assembly as shown in U.S. Pat. No. 4,906,161. It is necessary to removably connect the actuator body to the end of a boom carried by a backhoe or excavator, and to connect a bucket to the actuator shaft. When so connected, the operator may laterally tilt the bucket in a lateral plane generally transverse to the plane of rotation through which the boom moves.

In U.S. Pat. No. 4,906,161, the connection to the boom is made using an attachment bracket having a saddle portion which is bolted to the actuator body and two pair of attachment clevis comprising a pair of mounting plates formed as an integral unit with the saddle portion. One pair of clevis is used to connect the attachment bracket, and hence the actuator body, to an arm of the boom and the other pair of clevis is used to connect the attachment bracket to a rotation link movable by a hydraulic cylinder carried by the boom to rotate the bucket in the plane of rotation through which the boom moves. The use of such an attachment bracket requires that an inventory of attachment brackets be maintained to fit the various size actuator bodies being sold and the various size and style of booms with which the actuator may be used. Since the size, style and positioning of boom connection requirements are significantly different among the many types of backhoes and excavators in use today, and the loads involved dictate different size actuators, a large inventory of attachment brackets is required. This results in undesirable inventory costs and storage requirements.

Beyond the inventory problem, the use of an attachment bracket bolted to the actuator body is not always desirable. In part, this is because of the increased expense represented by the use of an attachment bracket; and also because the attachment bracket must be manufactured in advance of installation. Thus, delay can result or a sale can be lost because the proper size attachment bracket required for a particular backhoe or excavator is not available from inventory or perhaps not even currently being manufactured. The use of a prefabricated attachment bracket does not provide the ability to custom fit the actuator mounting plates to the backhoe or excavator at the time of installation.

Another drawback is that an attachment bracket must be bolted to the actuator body when it is often desirable and less expensive to simply weld the actuator mounting plates to the actuator body. Direct welding allows for customization by the installer and eliminate the need and expense of carrying an inventory of attachment brackets. However, the welding process involves subjecting the actuator to great heat which can result in damage to the fluid seals within the actuator body. It is not feasible for an installer to dismantle the actuator in the field to remove the seals so that the mounting plates can be welded to the actuator body, and then reassemble the actuator. Besides the difficulty of doing so, the heat to which the body is subjected could warp the body sufficiently to cause a problem when reassembled. Welding the mounting plates to the body prior to assembly of the actuator requires a large inventory of actuators and custom fits are not possible.

Attempts made in the past to weld mounting plates to a fully assembled actuator have too often resulted in damage to the fluid seals. Such attempts involve awkward procedures which are considered unsatisfactory and not sufficiently reliable. One example of such a procedure is to immerse the actuator into a cooling vat except for the portion of the actuator body to which the attachment bracket is to be welded. Even using this time-consuming procedure, seals are sometimes damaged. Generally, a damaged seal requires expensive repair, and sometimes return of the actuator to the manufacturer to accomplish the repair. The customer is thereby delayed if another actuator is not available.

It will, therefore, be appreciated that there has long been a significant need for a fluid-powered actuator and method of attaching mounting plates which permit custom installation of the mounting plates in the field.

DISCLOSURE OF THE INVENTION

The present invention resides in a fluid-powered actuator having a body with a longitudinal axis, and first and second ends. The actuator further includes a shaft extending longitudinally and generally coaxially within the body and supported for rotation relative to the body. The shaft is adapted for coupling to an external device to provide rotary drive thereto. A piston is mounted for reciprocal longitudinal movement within the body in response to selective application of fluid pressure thereto.

A torque-transmitting member is also mounted for reciprocal longitudinal movement within the body. The torque-transmitting member engages the body and the shaft to translate longitudinal movement of the piston toward one of the body ends into clockwise relative rotational movement between the shaft and the body, and longitudinal movement of the piston toward the other of the body ends into counterclockwise relative rotational movement between the shaft and the body. A plurality of seals positioned within the body to provide a fluid-tight seal between the body and the shaft, and between the piston and at least one of the shaft or the body.

A support member is positioned out of the body and fixedly attached to the body. At least one boom attachment member is weldable to the support member while the shaft, piston, torque-transmitting member, and seals remain assembled within the body. A fluid channel is positioned between the support member and the body. The channel is sized such that a heat-absorbing fluid passing through the channel will absorb and transport away from the body a sufficient portion of the heat applied to the support member by the welding of the boom attachment member thereto to prevent the heat absorbed by the body from damaging the seals within the body. The channel has an inlet to receive the fluid and an outlet to discharge the heated fluid from the channel.

In the illustrated embodiment of the invention, the actuator includes a first support member positioned out of the body and fixedly attached to the body toward the body first end, and a second support member positioned out of the body and fixedly attached to the body toward the body second end. The first support member has a first fluid channel formed at least partially by the first support member, and the second support member has a second fluid channel formed at least partially by the second support member.

In both illustrated embodiments, the support member has an attachment portion extending circumferentially about the body and a mounting portion. In one illustrated embodiment, the boom attachment member is weldable to the support member mounting portion. In an alternative embodiment, the support member includes a mounting platform extending longitudinally along the body with the platform fixedly attached to the body by the attachment portion of the support member. In this embodiment, the fluid channel extends longitudinally along the body. The fluid channel is defined by an elongated space between the longitudinally extending mounting platform and the body.

The invention further includes a method of attaching a boom attachment member to an assembled fluidpowered actuator having the construction set forth above. The method includes welding the boom attachment member to the support member while the shaft, piston, torquetransmitting members, and seals are assembled within the body, and supplying a flow of heat-absorbing fluid to the channel while welding the boom attachment member to the support member. In such fashion, the heat applied to the support member by the welding is absorbed and transported away from the body. A sufficient portion of the heat applied to the support member by the welding is transported away to maintain the temperature at which the seals are exposed below a critical temperature at which the seals are subject to damage.

Other features and advantages of the invention will become apparent form the following detailed description, taken in conjunction with the accompanying drawings.

DETAILED DESCRIPTION OF THE INVENTION

Figure 1:
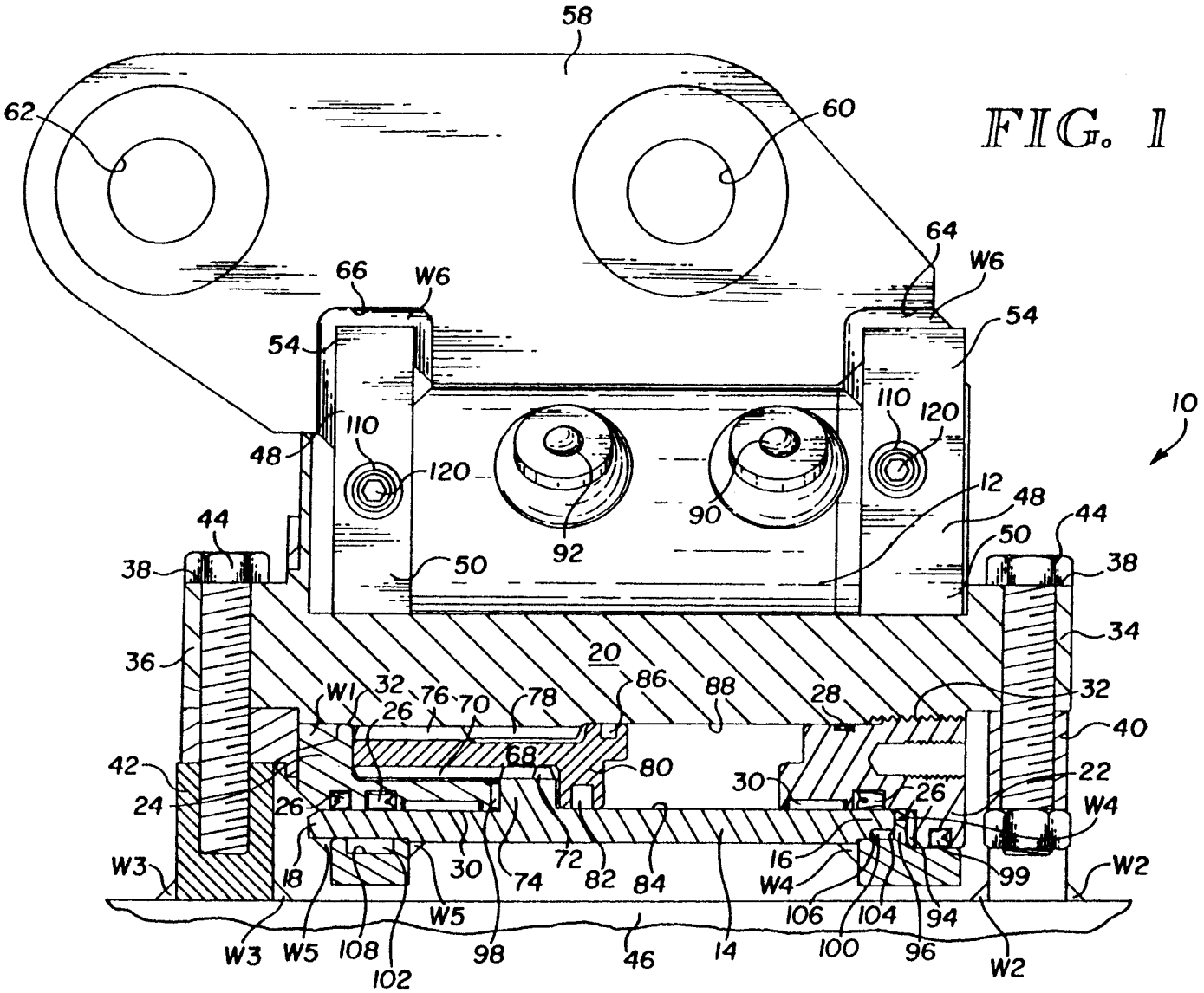
FIG. 1 is a side elevational, sectional view of a fluid-powered actuator embodying the present invention, shown attached to a work implement shown in fragment.

As shown in the drawings for purposes of illustration, the present invention is embodied in a fluid-powered rotary actuator 10 for use as part of a laterally tiltable bucket assembly or any other assembly requiring the actuator to be connected to a backhoe, excavator or other vehicle having a boom for rotation of a bucket or other work implement such as shown in U.S. Pat. No. 4,906,161. The actuator 10 includes an elongated housing or body 12 having a cylindrical sidewall 14 and first and second ends 16 and 18, respectively. A rotary output shaft 20 is coaxially positioned within the body 12 and supported for rotation relative to the body, as will be described in more detail below.

The shaft 20 includes a first flange 22 threadably attached to the shaft at the body first end 16 for rotation with the shaft. A second flange 24 is fixedly attached to the shaft 20 by a weld W1 at the body second end 18 for rotation with the shaft. Conventional fluid seals 26 are disposed between the first and second flanges 22 and 24 and the body sidewall 14 to provide a fluid-tight seal therebetween. A conventional O-ring seal 28 is disposed between the first flange 22 and the shaft 20 to provide fluid-tight seals therebetween. A conventional bearing 30 is disposed between each of the first and second flanges 22 and 24 and the body sidewall 14 to rotatably support the shaft 20 for rotation relative to the body 12.

The shaft 20 extends the full length of the body 12 and extends through a central aperture 32 in each of the first and second flanges 22 and 24 to the exterior of the body. The shaft 20 terminates in a first end portion 34 extending exterior of the body 12 beyond the body first end 16 and a second end portion 36 extending exterior of the body beyond the body second end 18. Each of the shaft first and second end portions 34 and 36 has a flat side 38 to facilitate its attachment to a corresponding one of a first or second attachment clamp 40 or 42 using bolts 44. The first and second attachment clamps 40 and 42 are fixedly attached by welds W2 and W3, respectively, to a work implement 46 to be rotated by the rotational drive supplied thereto by the shaft 20.

The body 12 has a pair of mounting plate support members 48. Each of the support members 48 has a ring attachment portion 50 extending circumferentially fully about the body sidewall 14 to define a central aperture 52 sized to receive the body 12 therein. One support member 48 is located at the body first end 16 and one is located at the body second end 18. The body 12 and the support members 48 are fabricated using a low-carbon weldable steel. The ring attachment portion 50 of the support member 48 at the body first end 16 is fixedly attached to the body sidewall 14 by a weld W4. The ring attachment portion 50 of the support member 48 at the body second end 18 is fixedly attached to the body sidewall 14 by a pair of welds W5.

Figure 2:
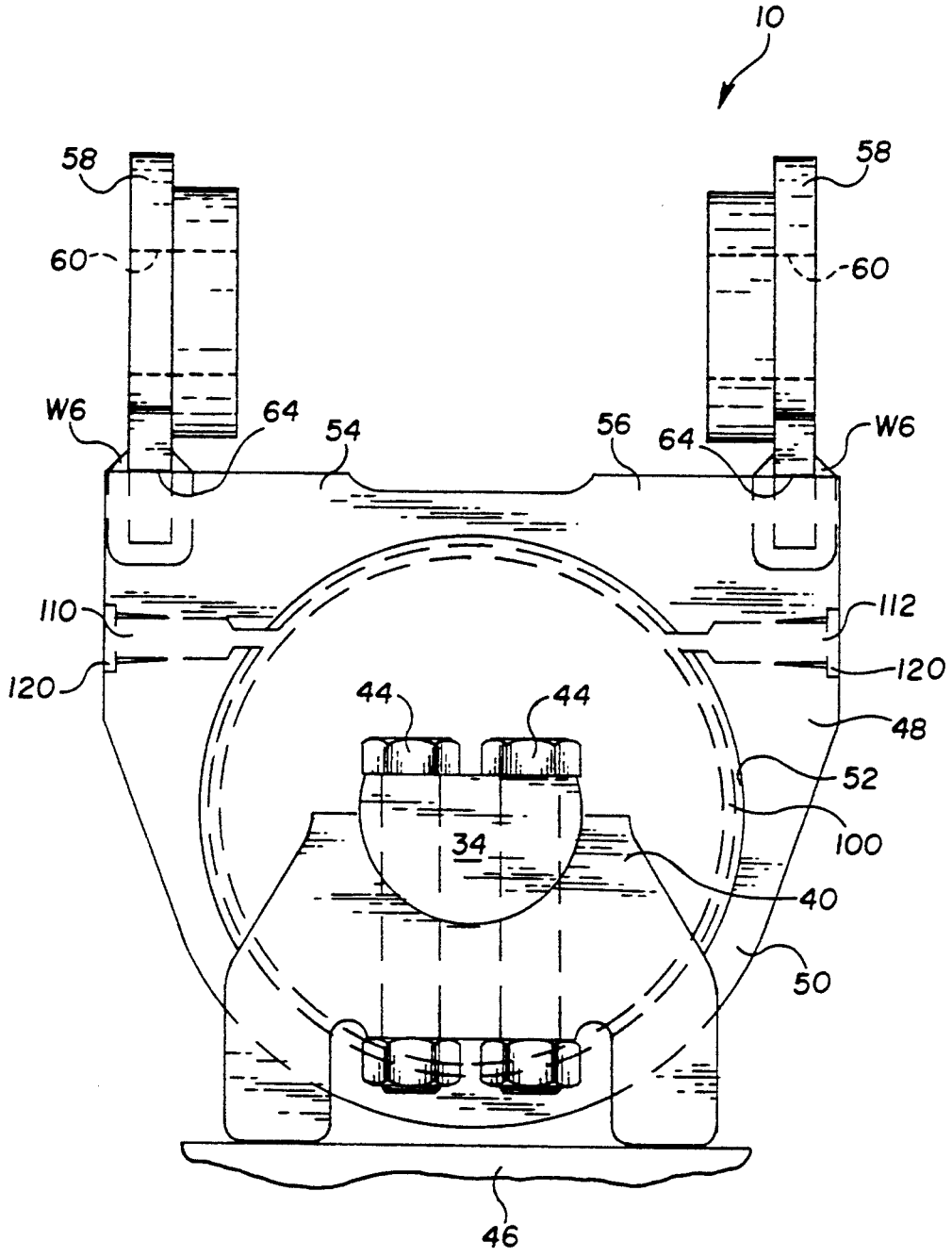
FIG. 2 is a first end elevational view of the actuator of FIG. 1.

Each of the support members 48 also includes left and right mounting wall portions 54 and 56, respectively, as viewed from the body first end 16 shown in FIG. 2. The mounting wall portions 54 and 56 of each support member 48 project outward beyond the body sidewall 14 and are located on a side of the body 12 generally opposite the work implement 46 when the shaft 20 is in a midposition between its full end limit of rotary travel in the clockwise and counterclockwise directions. The mounting wall portions 54 and 56 of each support member 48 are in generally coplanar alignment in a plane transverse to the longitudinal axis of the body 12.

The body 12 is connectable in a conventional manner to a boom (not shown) of a backhoe, excavator or other vehicle for travel and rotation of the body within a plane of rotation through which the boom moves through use of a pair of laterally spaced-apart boom side mounting plates 58. This permits corresponding movement and rotation of the work implement 46 connected to the shaft 20 within the boom plane in a conventional manner. The boom mounting plates 58 are arranged generally parallel to the longitudinal axis of the body 12, and each has first and second spaced-apart apertures 60 and 62, respectively. The first apertures 60 of the boom mounting plates 58 are positioned toward the body first end 16 and aligned with each other and sized to define a first clevis portion which receives either the free end of an arm or an associated rotation link of the boom using a selectively removable pin (not shown). The second apertures 62 of the boom mounting plates 58 are positioned toward the body second end 18 and aligned with each other and sized to define a second clevis portion which receives the other of the free end of the boom arm or the associated rotation link using a selectively removable pin (not shown). With this arrangement, the body is pivotally connected to the boom arm and the rotation link for movement with the free end of the boom arm, and also for rotation through the boom plane upon actuation of a hydraulic cylinder (not shown) connected between the boom arm and the rotation link in the manner shown in U.S. Pat. No. 4,906,161.

Each of the boom mounting plates 58 has spacedapart first and second notches 64 and 66, respectively. The first notch 64 is positioned toward the body first end 16 and sized to receive therein the corresponding left or right mounting wall portions 54 or 56 of the support member 48 located toward the body first end. The second notch 66 is positioned toward the body second end 18 and sized to receive therein the corresponding left or right mounting wall portions 54 or 56 of the support member 48 located toward the body second end. The mounting plates 58 are fixedly attached directly to the mounting wall portions 54 and 56 by welds W6.

The left and right mounting wall portions 54 and 56 of each support member 48 have sufficient length in the lateral direction transverse to the longitudinal axis of the body 12 to permit the welding of the mounting plates 58 at any laterally spaced-apart position which accommodates the width of the boom arm and rotation link for the vehicle with which the actuator 10 is to be used. For a smaller sized boom arm/rotation link, the mounting plates 58 can be welded in place laterally closer together on the left and right mounting wall portions 54 and 56. For a larger sized boom arm/rotation link, the mounting plates 58 can be welded in place laterally farther apart on the left and right mounting wall portions 54 and 56. The spacing is infinitely variable and allows custom fitting to the boom. Further, to accommodate a variety type of booms, it is only necessary to hold in inventory several different style mounting plates 58 or to fabricate the plates when needed. It is not necessary to inventor a different actuator for each size and type of boom. Further, a single style of mounting plate can be used on nearly any size actuator.

It is desirable that the welding of the mounting plates 58 to the mounting wall portions 54 and 56 be conducted in the field when the actuator 10 is being fitted to the boom of the vehicle with which it will be used. It is also desirable that the welding be conducted without requiring disassembly of the actuator 10 to avoid damage to the seals within the body 12. The construction of the actuator 10 which allows this will be described in detail below.

The fluid-powered operation of the actuator 10 will first be described. With the mounting plates 58 fixedly attached to the mounting wall portions 54 and 56 of the support members 48, which as described above are fixedly attached to the body 12, the rotation of the shaft 20 relative to the body 12 will result in rotation of the work implement 46 through a plane generally transverse to the boom plane. The rotation of the shaft 20 is accomplished by a conventional linear-to-rotary transmission means which includes an annular piston sleeve 68 reciprocally mounted within the body 12 coaxially about the shaft 20 as shown in FIG. 1. The piston sleeve 68 has outer helical splines 70 over a portion of its length which mesh with inner helical splines 72 formed on an inwardly projecting gear portion 74 of the body sidewall 14 which serves as a ring gear. The piston sleeve 68 is also provided with inner helical splines 76 which mesh with outer helical splines 78 provided on a splined 10 portion of the shaft 20. It should be understood that while helical splines are shown in the drawings and described herein, the principle of the invention is equally applicable to any form of linear-to-rotary motion conversion means, such as balls or rollers.

In the illustrated embodiment of the invention, the piston sleeve 68 has an annular piston 80 positioned at an end of the piston sleeve toward the body first end 16. The piston 80 is slideably maintained within the body 12 for reciprocal movement, and undergoes longitudinal and rotational movement relative to the body 12 during fluid-powered operation of the actuator 10, as will be described in more detail below.

A seal 82 is disposed between the piston 80 and a smooth interior wall surface 84 of the body 12 to provide a fluid-tight seal therebetween. A seal 86 is disposed between the piston 80 and a smooth exterior wall surface 88 of the shaft 20 to provide a fluid-tight seal therebetween.

As will be readily understood, reciprocation of the piston 80 within the body 12 occurs when hydraulic oil, air or any other suitable fluid under pressure selectively enters through a first port 90 to a side of the piston toward the body first end 16 or through a second port 92 to the other side of the piston toward the body second end 18. As the piston 80, and the piston sleeve 68 of which the piston is a part, linearly reciprocates in an axial direction within the body 12 as a result of selective application of pressurized fluid to the piston, the outer helical splines 70 of the piston sleeve engage or mesh with the inner helical splines 72 of the gear portion 74 of the body sidewall 14 to cause rotation of the piston sleeve. The linear and rotational movement of the piston sleeve 68 is transmitted through the inner helical splines 76 of the piston sleeve to the outer helical splines 78 of the shaft 20 to cause the shaft to rotate relative to the body 12.

The axial movement of the shaft 20 is restricted in one axial direction by a thrust bearing 94 positioned between the shaft first flange 22 and a circumferentially extending, radially inward-projecting flange 96 of the attachment portion 50 of the support member 48 at the body first end 16. The axial movement of the shaft 20 is restricted in an opposite axial inward direction by a thrust bearing 98 positioned between the shaft second flange 24 and the body gear portion 74. As such, all movement of the piston sleeve 68 is converted into rotational movement of the shaft 20. Depending on the slope and direction of turn of the various helical splines, there may be provided a multiplication of the rotary output of the shaft 20. A conventional fluid seal 99 is disposed between the first flange 22 and the attachment portion 50 of the support member 48 at the body first end 16 to provide a fluid-tight seal therebetween.

The application of fluid pressure to the port 90 produces axial movement of the piston sleeve 68 toward the body second end 18. The application of fluid pressure to the port 92 produces axial movement of the piston sleeve 68 toward the body first end 16. The actuator 10 provides relative rotational movement between the body 12 and the shaft 20 through the conversion of this linear movement of the piston sleeve 68 into rotational movement of the shaft, in a manner well known in the art.

The welds W1, W4 and W5 are made during manufacture of the actuator 10 before assembly of the shaft 20, the piston sleeve 68 and the first and second flanges 22 and 24 within the body 12. Thus, the seals 26, 28, 82, 86 and 99 are not exposed to the heat produced by the welding. Further, the welds W2 and W3 which attach the first and second attachment clamps 40 and 42 to the work implement 46 can be made during manufacture or in the field, but are made with the shaft 20 unbolted from the clamps to avoid exposing any seals to the heat produced by the welding. However, it is very desirable to make the welds W6 which attach the mounting plates 58 to the mounting wall portions 54 and 56 of the support members 48 at the time of installation of the actuator 10 to the vehicle with which the actuator will be used. As described above, this allows the mounting plates 58 to be custom fit to the boom of the vehicle. Further, it is very desirable and essentially necessary for an in-the-field custom installation to make welds W6 with the actuator 10 fully assembled, thus exposing the seals 26, 28, 82, 86 and 99 to possible damage from the heat produced by the welding. These seals are manufactured from conventional materials which will distort or melt if exposed to heat above a critical temperature which depends on the type of material involved, thus resulting in failure of the seals and fluid leakage during fluidpowered operation of the actuator 10.

The heat to which the seals 26, 28, 82, 86 and 99 are exposed is kept below the critical temperature which damages the seal during the welding through use of circumferentially extending first and second water channels 100 and 102, respectively. Each of the channels 100 and 102 is formed between an inward side of one of the attachment portions 50 of the support members 48 and the body sidewall 14, and extends circumferentially fully about the body sidewall 14. The channel 100 is formed by the support member 48 at the body first end 16 and defined by a circumferentially extending inward surface portion 104 of the attachment portion 50, the inwardly projecting flange 96 and a shoulder cut-out 106 in the body sidewall 14 at the body first end 16. The weld W4 and the seals 26 and 99 carried by the shaft first flange 22 serve to seal the channel 100 against water leakage. The channel 102 is formed by the support member 48 at the body second end 18 and defined by a circumferentially extending groove 108 cut in the inward surface of the attachment 50 and the body sidewall 14. The welds W5 serve to seal the channel 103 against water leakage.

The channels 100 and 102 are sized such that sufficient cooling water can be passed therethrough while the welds W6 are being made to absorb and transport away from the body 12 a sufficient portion of the heat applied to the support members 48 by the welding of the mounting plates 58 thereto to keep the temperature to which the seals 26, 28, 82, 86 and 99 are exposed below the critical temperature at which seal damage occurs. To provide for the flow of the cooling water, each of the support members 48 has a port 110 formed on one side thereof and another port 112 formed on an opposite side thereof. Both of the ports 110 and 112 for a support member 48 are in fluid communication with the corresponding channel 100 or 102. The channels 100 and 102 are located immediately radially outward of the positions of the seals 26 and axially adjacent to the seal 99 which are most exposed to damage from the heat produced by making the welds W6.

Figure 3:
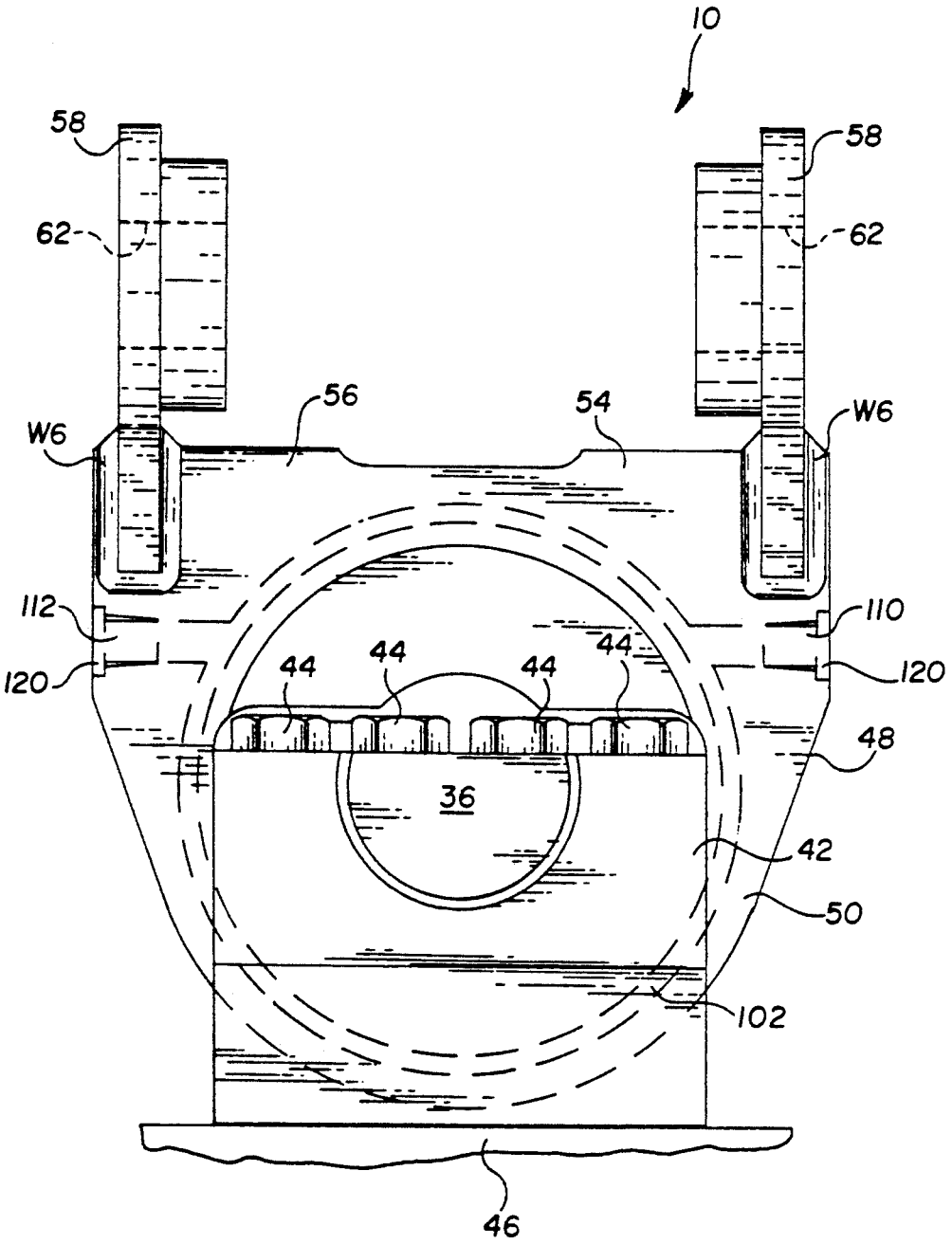
FIG. 3 is a second end elevational view of the actuator of FIG. 1.
Figure 4:
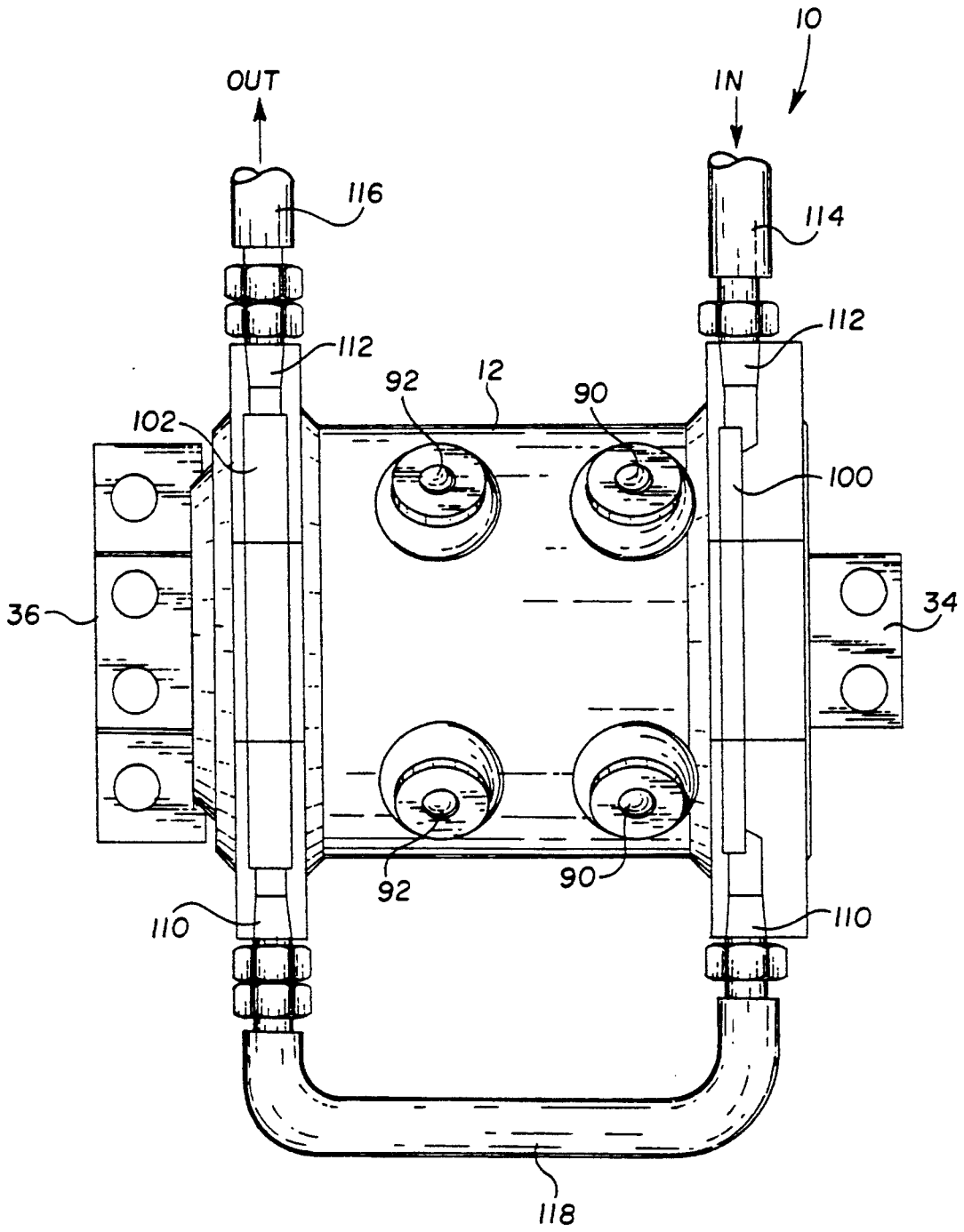
FIG. 4 is a reduced-scale, top plan view of the actuator of FIG. 1 shown without the boom attachment plates and with hoses connected to the actuator fluid channels for cooling of the actuator while the boom attachment plates are welded to support members.

As shown in FIG. 4, a supply hose 114 can be connected to the port 112 of the support member 48 at the body first end 16 to supply the cooling water thereto, and a return hose 116 can be connected to the port 112 of the support member 48 at the body second end 18 to discharge the heated cooling water. The ports 110 of the two support members 48 are interconnected with a connection hose 118 to conduct the cooling water between the two channels 100 and 102. By causing a continuous flow of the cooling water through the channels 100 and 102, a large portion of the heat of welding welds W6 can be transported away from the body 12, thus allowing welding of the mounting plates 58 in the field so as to custom fit them to the boom of the vehicle with which the actuator 10 will be used without requiring disassembly of the actuator. It is noted that the channels 100 and 102 each provide an upper circumferential path and a lower circumferential path for the flow of cooling water between the ports 110 and 112 of each support member 48, thus cooling the upper and the lower portions of the body 12. When the welding is done, the hoses 114, 116 and 118 are removed, the cooling water drained form the channels 100 and 102, and a threaded plug 120, such as shown in FIGS. 1, 2 and 3, is threaded into each of the four ports 110 and 112 to seal them. The channels 100 and 102 can be used again should it ever be necessary to re-weld the mounting plates 58.

Figure 5:
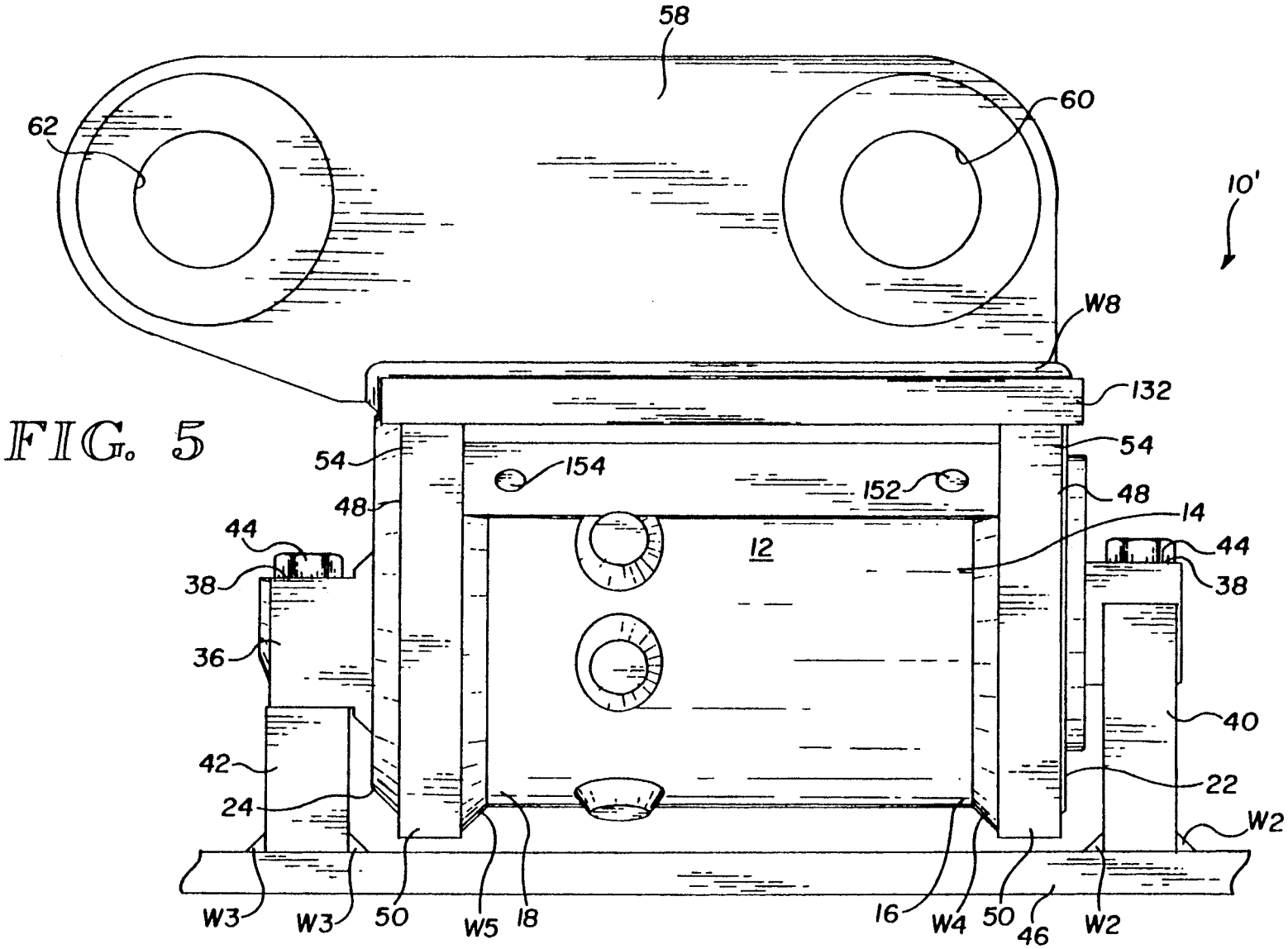
FIG. 5 is a side elevational view of a second embodiment of an actuator embodying the present invention using longitudinally extending support members with longitudinally extending fluid channels for cooling.
Figure 6:
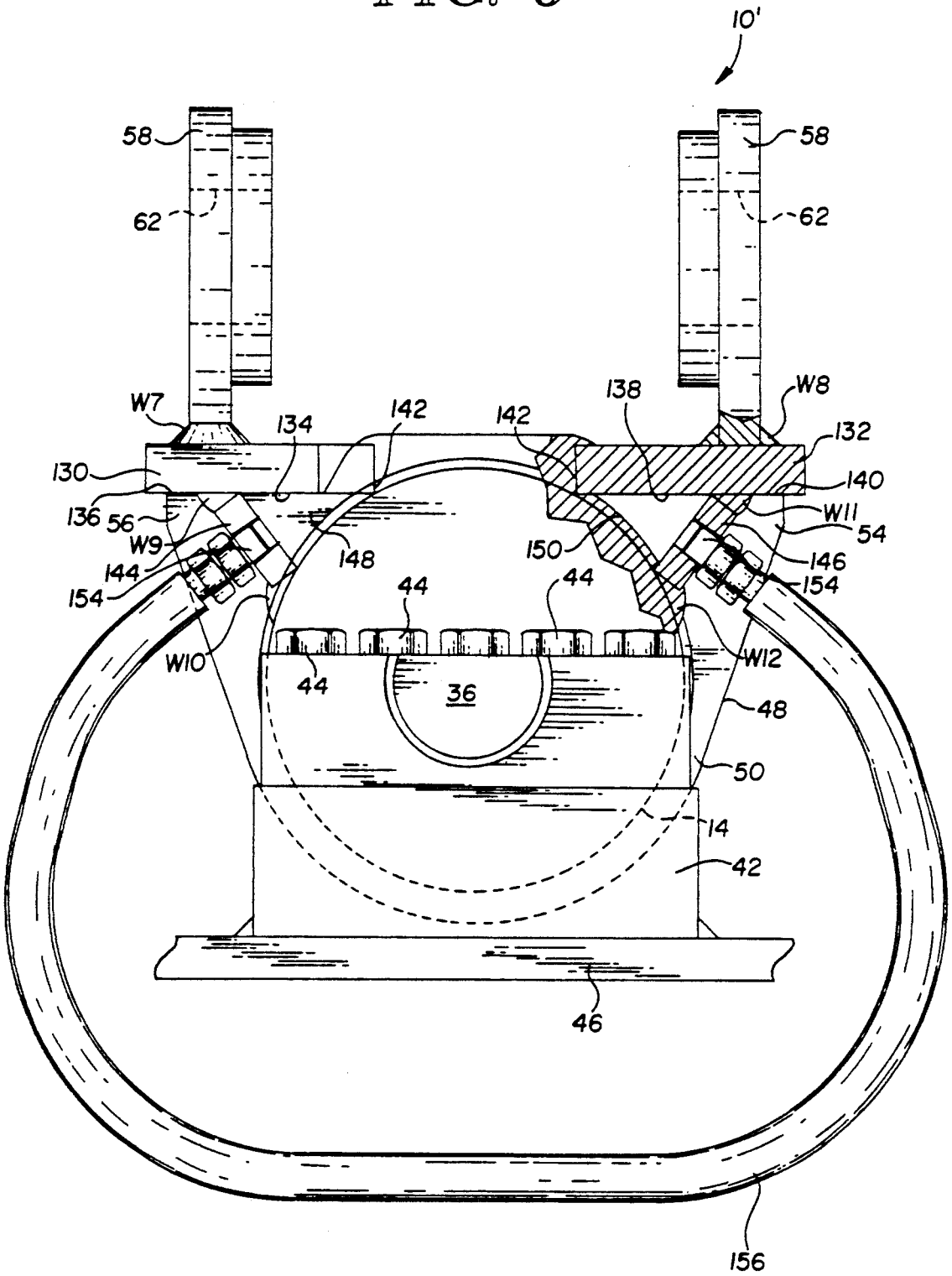
FIG. 6 is a second end elevational view of the actuator of FIG. 5.

An alternative embodiment of the actuator 10′ is shown in FIGS. 5 and 6. For ease of understanding, the components of the alternative embodiment will be similarly numbered with those of the first embodiment when of a similar construction. Only the significant differences in construction will be described in detail.

In the embodiment of FIGS. 5 and 6, the mounting plate support members 48 each have left and right mounting wall portions 54 and 56, however, they do not project above the body sidewall 14 and the mounting plates 58 are not welded directly to them. Instead, the mounting wall portions 54 and 56 provide flat surfaces to which are attached a pair of right and left planar mounting platforms 130 and 132, respectively, as viewed form the body second end 18 shown in FIG. 6. The right mounting wall portions 56 of the support members 48 have the right mounting platform 130 extending longitudinally therebetween and therebeyond, and have a face 134 of the right mounting platform in contact with an edge wall 136 thereof. Similarly, the left mounting wall portions 54 of the support members 48 have the left mounting platform 132 extending longitudinally therebetween and therebeyond, and have a face 138 of the left mounting platform in contact with an edge wall 140 thereof. The right and left mounting platforms 130 and 132 are in generally coplanar alignment in a plane parallel to the longitudinal axis of the body 12.

An inward corner 142 of each of the right and left mounting platforms 130 and-132 is in contact with the body sidewall 14. The right and left mounting platforms 130 and 132 are fixedly attached by welds (not shown) to the right and left mounting wall portions 54 and 56, and to the body sidewall 14, with the welds also providing a fluid-tight connection therebetween.

In this embodiment, a right one of the boom mounting plates 58 is fixedly attached to the right mounting platform 130 by a weld W7, and a left one of the boom mounting plates is fixedly attached to the left mounting platform 132 by a weld W8. This allows the custom fit of the boom mounting plates 58 to the boom with which the actuator 10′ will be used.

The support members 48 may be constructed with or without the circumferentially extending first and second water channels 100 and 102 described above for the embodiment of FIGS. 1–4. In the illustrated embodiment in FIGS. 5 and 6, such channels are not utilized. Instead, the actuator 10′ has right and left cooling chamber sidewalls 144 and 146, respectively, which define longitudinally extending right and left water chambers 148 and 150, respectively. The right chamber sidewall 144 is fixedly attached by a weld W9 to the right mounting platform 130 and by a weld W10 to the body sidewall 14. The left chamber sidewall 146 is fixedly attached by a weld W11 to the left mounting platform 132 and by a weld W12 to the body sidewall 14. The welds W9, W10, W11 and W12 provide a fluid-tight connection between the welded components.

The right water chamber 148 is defined by the right chamber sidewall 144, the right mounting platform 130 and the body sidewall 14. Similarly, the left water chamber 150 is defined by the left chamber sidewall 146, the left mounting platform 132 and the body sidewall 14. The longitudinal ends of the right and left water chambers 144 and 146 are sealed by the support members 48.

The actuator 10′ allows the welds W7 and W8 used to attach the mounting plates 58 to the right and left mounting platforms 130 and 132 to be made at the time of installation of the actuator 10′ to the vehicle with which the actuator will be used, while the actuator is fully assembled and without damage to the seals therein. This allows the mounting plates 58 to be custom fit to the boom of the vehicle. The heat to which the seals are exposed is kept below the critical temperature which damages the seals during welding by passing cooling water through the right and left water chambers 148 and 150.

To provide for the flow of the cooling water, each of the right and left chamber sidewalls 144 and 146 has first and second ports 152 and 154, respectively. The first port 152 is formed toward the body first end 16 and the second port 154 is formed toward the body second end 18. Both of the ports 152 and 154 for a chamber sidewall 144 or 146 are in fluid communication with the corresponding right or left water chambers 148 or 150. The right and left water chambers 148 and 150 are sized such that sufficient cooling water can be passed therethrough while the welds W7 and W8 are being made to absorb and transport away from the .body 12 a sufficient portion of the heat applied to the right and left mounting platforms 130 and 132 by the welding of the mounting plates 58 thereto to keep the temperature to which the seals within the body 12 are exposed below the critical temperature. The right and left water chambers 148 and 150 are located between the mounting platforms 130 and 132 and the body sidewall 14 to improve the protection provided without use of a water jacket surrounding the entire body 12.

As partially shown in FIG. 6, and as shown and described for the embodiment of FIGS. 1–4, a supply hose (not shown) can be connected to the port 152 of the right or left water chamber 148 or 150 to supply the cooling water thereto, and a return hose (not shown) can be connected to the port 152 of the other of the right or left water chamber to discharge the heated cooling water. The ports 154 of the right and left water chambers 148 and 150 are interconnected with a hose 156 to conduct the cooling water between the two water chambers. By causing a continuous flow of the cooling water through the water chambers 148 and 150, a large portion of the heat of welding welds W7 and W8 can be transported away from the body 12, thus allowing welding of the mounting plates 58 in the field so as to custom fit them to the boom of the vehicle with which the actuator 10′ will be used without requiring disassembly of the actuator. As noted above, additional cooling can be accomplished by also forming the support members 48 with the water channels 100 and 102 described for the embodiment of FIGS. 1–4. In such fashion, the longitudinally extending water chambers 148 and 150 work with the circumferentially extending water channels 100 and 102 to provide increased seal protection from the heat of welding.

It will be appreciated that, although specific embodiments of the invention have been described herein for purposes of illustration, various modifications may be made without departing from the spirit and scope of the invention. Accordingly, the invention is not limited except as by the appended claims.

We claim:

1. A fluid-powered actuator, comprising:

a body having a longitudinal axis, and first and second ends;

a shaft extending longitudinally and generally coaxially within said body and being supported for rotation relative to said body, said shaft being adapted for coupling to an external device to provide rotational drive thereto;

a piston mounted for reciprocal longitudinal movement within said body in response to selective application of pressurized fluid thereto;

a torque-transmitting member mounted for reciprocal longitudinal movement within said body, said torquetransmitting member engaging said body and said shaft to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body;

a plurality of seals positioned within said body to provide a fluid-tight seal between said body and said shaft and between said piston and at least one of said shaft or said body;

a support member positioned out of said body and fixedly attached to said body;

at least one boom attachment member weldable to said support member while said shaft, piston, torque-transmitting member, and seals are assembled within said body; and a fluid channel positioned between said support member and said body and sized such that a heat-absorbing fluid passing through said channel will absorb and transport away from said body a sufficient portion of the heat applied to said support member by the welding of said boom attachment member thereto to prevent the heat absorbed by said body from damaging said seals within said body, said channel having an inlet to receive the fluid and an outlet to discharge the heated fluid from said channel.

2. A fluid-powered actuator, comprising:

a body having a longitudinal axis, and first and second ends;

a shaft extending longitudinally and generally coaxially within said body and being supported for rotation relative to said body, said shaft being adapted for coupling to an external device to provide rotational drive thereto;

a piston mounted for reciprocal longitudinal movement within said body in response to selective application of pressurized fluid thereto;

a torque-transmitting member mounted for reciprocal longitudinal movement within said body, said torquetransmitting member engaging said body and said shaft to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body;

a plurality of seals positioned within said body to provide a fluid-tight seal between said body and said shaft and between said piston and at least one of said shaft or said body;

a support member positioned out of said body and fixedly attached to said body;

at least one boom attachment member weldable to said support member; and a fluid channel positioned between said support member and said body, said channel being sized to conduct a heat-absorbing fluid through said channel to absorb and transport away from said body heat applied to said support member by the welding of said boom attachment men, her thereto, said channel having an inlet to receive the fluid and an outlet to discharge the heated fluid from said channel.

3. A fluid-powered actuator, comprising:

a tubular body having a longitudinal axis, and first and second ends;

a shaft extending longitudinally and generally coaxially within said body and being supported for rotation relative to said body, said shaft being adapted for coupling to an external device to provide rotational drive thereto;

a piston mounted for reciprocal longitudinal movement within said body in response to selective application of pressurized fluid thereto;

a torque-transmitting member mounted for reciprocal longitudinal movement within said body, said torque-transmitting member engaging said body and said shaft to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body;

a plurality of seals positioned within said body to provide a fluid-tight seal between said body and said shaft and between said piston and at least one of said shaft or said body;

a first support member positioned out of said body and fixedly attached to said body toward said body first end;

a second support member positioned out of said body and fixedly attached to said body toward said body second end;

at least one boom attachment member weldable to said first and second support members while said shaft, piston, torque-transmitting member, and seals are assembled within said body;

a first fluid channel formed at least partially by said first support member and sized such that a heat-absorbing fluid passing through said first channel will absorb and transport away from said body a sufficient portion of the heat applied to said first support member by the welding of said boom attachment member thereto to prevent the heat absorbed by said body from damaging said seals within said body, said first channel having an inlet to receive the fluid and an outlet to discharge the heated fluid from said first channel; and a second fluid channel formed at least partially by said second support member and sized such that a heat-absorbing fluid passing through said second channel will absorb and transport away from said body a sufficient portion of the heat applied to said second support member by the welding of said boom attachment member thereto to prevent the heat absorbed by said body from damaging said seals within said body, said second channel having an inlet to receive the fluid and an outlet to discharge the heat fluid from said second channel.

4. A fluid-powered actuator, comprising:

a tubular body having a longitudinal axis, and first and second ends;

a shaft extending longitudinally and generally coaxially within said body and being supported for rotation relative to said body, said shaft being adapted for coupling to an external device to provide rotational drive thereto;

a piston mounted for reciprocal longitudinal movement within said body in response to selective application of pressurized fluid thereto;

a torque-transmitting member mounted for reciprocal longitudinal movement within said body, said torque-transmitting member engaging said body and said shaft to translate longitudinal movement of said piston toward one of said body first or second ends into clockwise relative rotational movement between said shaft and said body and longitudinal movement of said piston toward the other of said body first or second ends into counterclockwise relative rotational movement between said shaft and said body;

a plurality of seals positioned within said body to provide a fluid-tight seal between said body and said shaft and between said piston and at least one of said shaft or said body;

a first support member positioned out of said body and fixedly attached to said body toward said body first end;

a second support member positioned out of said body and fixedly attached to said body toward said body second end;

at least one boom attachment member weldable to said first and second support members;

a first fluid channel formed at least partially by said first support member to conduct a heat-absorbing fluid through said first channel to absorb and transport away from said body heat applied to said first support member by the welding of said boom attachment member thereto, said first channel having an inlet to receive the fluid and an outlet to discharge the heated fluid from said first channel; and a second fluid channel formed at least partially by said second support member to conduct a heat-absorbing fluid through said second channel to absorb and transport away from said body heat applied to said second support member by the welding of said boom attachment member thereto, said second channel having an inlet to receive the fluid and an outlet to discharge the heat fluid from said second channel.

5. A fluid-powered actuator, comprising:

a tubular body having a longitudinal axis, and first and second ends;

a shaft extending longitudinally and generally coaxially within said body and being supported for rotation relative to said body, said shaft being adapted for coupling to an external device to provide rotational drive thereto;

a piston mounted for reciprocal longitudinal movement within said body in response to selective application of pressurized fluid thereto;

a torque-transmitting member mounted for reciprocal longitudinal movement within said body, said torque-transmitting member engaging said body and said shaft to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body;

a plurality of seals positioned within said body to provide a fluid-tight seal between said body and said shaft and between said piston and at least one of said shaft or said body;

a support member positioned out of said body and fixedly attached to said body, said support member having an attachment portion extending circumferentially about said body and a mounting portion;

at least one boom attachment member weldable to said support men%her mounting portion while said shaft, piston, torque-transmitting member, and seals are assembled within said body; and a circumferentially extending fluid channel positioned between said support member attachment portion and said body and sized such that a heat-absorbing fluid passing through said channel will absorb and transport away from said body a sufficient portion of the heat applied to said support member mounting portion by the welding of said boom attachment men%her thereto to prevent the heat absorbed by said body from damaging said seals within said body, said channel having an inlet to receive the fluid and an outlet to discharge the heated fluid from said channel.

6. The actuator of claim 5 wherein said support member attachment portion extends circumferentially fully about said body and said channel extends circumferentially fully about said body.

7. The actuator of claim 5 wherein said channel extends circumferentially about said body with a portion thereof extending between said support member mounting portion and said body.

8. The actuator of claim 5 wherein said channel is at least partially formed in an inward wall of said support member attachment portion facing toward said body.

9. The actuator of claim 5 wherein said channel is at least partially defined by a groove formed in an inward wall of said support member attachment portion facing toward said body.

10. The actuator of claim 5 wherein said boom attachment member has a notch to receive said support member mounting portion therein when welded to said support member mounting portion.

11. A fluid-powered actuator, comprising:

a tubular body having a longitudinal axis, and first and second ends;

a shaft extending longitudinally and generally coaxially within said body and being supported for rotation relative to said body, said shaft being adapted for coupling to an external device to provide rotational drive thereto;

a piston mounted for reciprocal longitudinal movement within said body in response to selective application of pressurized fluid thereto;

a torque-transmitting member mounted for reciprocal longitudinal movement within said body, said torque-transmitting member engaging said body and said shaft to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body;

a plurality of seals positioned within said body to provide a fluid-tight seal between said body and said shaft and between said piston and at least one of said shaft or said body;

a support member positioned out of said body and fixedly attached to said body, said support member extending longitudinally along said body;

at least one boom attachment member weldable to said support men%her while said shaft, piston, torque-transmitting member, and seals are assembled within said body; and a longitudinally extending fluid channel positioned between said support member and said body and sized such that a heat-absorbing fluid passing through said channel will absorb and transport away from said body a sufficient portion of the heat applied to said support member by the welding of said boom attachment member thereto to prevent the heat absorbed by said body from damaging said seals within said body, said channel having an inlet to receive the fluid and an outlet to discharge the heated fluid from said channel.

12. The actuator of claim 11 wherein said support member is fixedly attached to said body by at least one attachment member extending circumferentially about said body.

13. The actuator of claim 12 wherein said attachment member has a mounting portion at which said support member is fixedly attached.

14. The actuator of claim 11 wherein said support men%her is a longitudinally extending mounting platform positioned with at least a portion thereof spaced away from said body to define an elongated space between said support member and said body which at least in part forms said channel.

15. A fluid-powered actuator attachable to a boom by at least one boom attachment member by welding while the actuator is assembled, comprising:

a body having a longitudinal axis, and first and second ends;

a shaft extending longitudinally and generally coaxially within said body and being supported for rotation relative to said body, said shaft being adapted for coupling to an external device to provide rotational drive thereto;

a piston mounted for reciprocal longitudinal movement within said body in response to selective application of pressurized fluid thereto;

a torque-transmitting men, her mounted for reciprocal longitudinal movement within said body, said torquetransmitting member engaging said body and said shaft to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body;

a plurality of seals positioned within said body to provide a fluid-tight seal between said body and said shaft and between said piston and at least one of said shaft or said body, said seals being subject to damage if exposed to heat above a critical temperature;

a support member positioned out of said body and fixedly attached to said body; and a fluid channel positioned at least partially within said support member and sized such that a heat-absorbing fluid passing through said channel will absorb and transport away from said body a sufficient portion of the heat applied to said support member by the welding of the boom attachment member thereto to maintain the temperature to which said seals are exposed below said critical temperature to avoid damage to said seals within said body, said channel having an inlet to receive the fluid and an outlet to discharge the heated fluid from said channel.

16. A method of attaching at least one boom attachment member to an assembled fluid-powered actuator by welding, comprising:

providing an assembled actuator having a tubular body with a longitudinal axis, and first and second ends, a shaft extending longitudinally and generally coaxially within said body and being supported for rotation relative to said body, said shaft being adapted for coupling to an external device to provide rotational drive thereto, a piston mounted for reciprocal longitudinal movement within said body in response to selective application of pressurized fluid thereto, a torque-transmitting member mounted for reciprocal longitudinal movement within said body, said torque-transmitting member engaging said body and said shaft to translate longitudinal movement of said piston toward one of said body first or second ends into clockwise relative rotational movement between said shaft and said body, and longitudinal movement of said piston toward the other of said body first or second ends into counterclockwise relative rotational movement between said shaft and said body, and a plurality of seals positioned within said body to provide a fluid-tight seal between said body and said shaft and between said piston and at least one of said shaft or said body;

providing a support men, her positioned out of said body and fixedly attached to said body;

providing a fluid channel positioned between said support member and said body, said channel having an inlet to receive fluid and an outlet to discharge the fluid from said channel;

welding the boom attachment member to said support member while said shaft, piston, torque-transmitting member, and seals are assembled within said body;

supplying a flow of head-absorbing fluid to said channel while welding the boom attachment member to said support member to absorb and transport away from said body a sufficient portion of the heat applied to said support member by the welding of the boom attachment men, her thereto to prevent the heat absorbed by said body from damaging said seals within said body.

* * * * *

UNITED STATES PATENT AND TRADEMARK OFFICE

CERTIFICATE OF CORRECTION

PATENT NO. : 5,327,812

DATED : July 12, 1994

INVENTOR(S) : Paul P. Weyer and Dean R. Weyer

It is certified that error appears in the above-identified patent and that said Letters Patent is hereby corrected as shown below:

In column 11, claim 1, line 9, please delete "torquetransmitting" and substitute therefor --torque-transmitting--.

In column 11, claim 2, line 52, please delete "torquetransmitting" and substitute therefor --torque-transmitting--.

In column 12, claim 2, line 6, please delete "men, her" and substitute therefor --member--.

In column 14, claim 5, line 14, please delete "men%her" and substitute therefor --member--.

In column 14, claim 5, line 24, please delete "men%her" and substitute therefor --member--.

In column 15, claim 11, line 11, please delete "men%her" and substitute therefor --member--.

In column 15, claim 14, line 33, please delete "men%her" and substitute therefor --member--.

In column 15, claim 15, line 51, please delete "men, her" and substitute therefor --member--.

In column 15, claim 15, line 53, please delete "torquetransmitting" and substitute therefor --torque-transmitting--.

In column 16, claim 16, line 46, please delete "men, her" and substitute therefor --member--.

UNITED STATES PATENT AND TRADEMARK OFFICE

CERTIFICATE OF CORRECTION

PATENT NO. : 5,327,812

DATED : July 12, 1994

INVENTOR(S) : Paul P. Weyer and Dean R. Weyer

It is certified that error appears in the above-identified patent and that said Letters Patent is hereby corrected as shown below:

In column 16, claim 16, line 61, please delete "men, her" and substitute therefor --member--.

Signed and Sealed this

Eighteenth Day of October, 1994

Bruce Lehman

*Attest:*

BRUCE LEHMAN

*Attesting Officer*

*Commissioner of Patents and Trademarks*